US009186035B2

(12) United States Patent
Hussain

(10) Patent No.: US 9,186,035 B2
(45) Date of Patent: Nov. 17, 2015

(54) METHOD OF OPERATING A HEATER IN A DISHWASHER

(71) Applicant: Whirlpool Corporation, Benton Harbor, MI (US)

(72) Inventor: Saadat Hussain, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 323 days.

(21) Appl. No.: 13/793,028

(22) Filed: Mar. 11, 2013

(65) Prior Publication Data

US 2014/0251979 A1 Sep. 11, 2014

(51) Int. Cl.
*H05B 1/02* (2006.01)
*A47L 15/42* (2006.01)

(52) U.S. Cl.
CPC ..... *A47L 15/42* (2013.01); *A47L 15/4285* (2013.01); *H05B 1/0252* (2013.01)

(58) Field of Classification Search
CPC ..... A47L 15/42; A47L 15/4288; H05B 1/02; H05B 1/0252
USPC ..... 219/492, 494, 483, 519, 509, 510
See application file for complete search history.

(56) References Cited

U.S. PATENT DOCUMENTS

| | | | | |
|---|---|---|---|---|
| 3,426,969 | A | 2/1969 | Anderson, Jr. | |
| 4,065,802 | A | 12/1977 | Mizukawa et al. | |
| 4,315,140 | A * | 2/1982 | Helwig, Jr. | 219/486 |
| 4,598,195 | A | 7/1986 | Matsuo | |
| 4,631,627 | A * | 12/1986 | Morgan | 361/153 |
| 4,868,486 | A | 9/1989 | Shinoda | |
| 5,821,642 | A | 10/1998 | Nishhira et al. | |
| 5,866,880 | A * | 2/1999 | Seitz et al. | 219/483 |
| 6,643,112 | B1 | 11/2003 | Carton et al. | |
| 6,919,815 | B2 * | 7/2005 | Peterson | 340/815.4 |
| 7,594,513 | B2 | 9/2009 | Vanderroest et al. | |
| 2003/0016048 | A1 * | 1/2003 | Dongowski et al. | 324/771 |
| 2007/0241100 | A1 | 10/2007 | Stickel | |
| 2012/0138096 | A1 * | 6/2012 | Tuller et al. | 134/19 |

(Continued)

FOREIGN PATENT DOCUMENTS

| | | | |
|---|---|---|---|
| DE | 3541635 | A1 | 5/1987 |
| EP | 2512204 | A1 | 10/2012 |
| JP | 2002296955 | A | 10/2002 |

(Continued)

OTHER PUBLICATIONS

European Search Report for Corresponding EP14157494.7, May 15, 2015.

*Primary Examiner* — Mark Paschall

(57) ABSTRACT

The invention relates to a method of operating an electric heater having a resistive heating element selectively coupled to an AC power supply by a first pair of contacts of a first relay having opened and closed state conditions and by a second pair of contacts of a second relay having opened and closed state conditions and a switch coupled in parallel to the second pair of contacts. The method includes changing a state condition of one of the first and second relays while maintaining the state condition of the other of the first and second relays; upon the changing of the state condition, shunting the output of the second relay contacts coupled with the resistive heating element to the switch; and changing the state condition of the other of the first and second relays after completion of debounce for the one of the first and second relays.

16 Claims, 4 Drawing Sheets

(56) References Cited

U.S. PATENT DOCUMENTS

| | | | | |
|---|---|---|---|---|
| 2014/0083460 | A1* | 3/2014 | McDonald | 134/18 |
| 2015/0068056 | A1* | 3/2015 | Jung et al. | 34/218 |

FOREIGN PATENT DOCUMENTS

| | | | |
|---|---|---|---|
| JP | 2012042573 | A | 3/2012 |
| WO | 2011/138129 | A1 | 11/2011 |

* cited by examiner

METHOD OF OPERATING A HEATER IN A DISHWASHER

BACKGROUND OF THE INVENTION

Dishwashers can include a heater for heating wash liquid for treating dishes according to an automatic cycle of operation. A heater may comprise a resistive heating element and a number of electrical components to couple the resistive heating element to a power supply. For example, a resistive heating element may be selectively coupled to the power supply by electromechanical relays.

BRIEF DESCRIPTION OF THE INVENTION

The invention relates to a method of operating an electric heater having a resistive heating element selectively coupled to a live wire of a single-phase AC power supply by a first pair of contacts of a first relay having opened and closed state conditions and selectively coupled to the neutral wire of the single-phase AC power supply by a second pair of contacts of a second relay having opened and closed state conditions and a switch coupled in parallel to the second pair of contacts. The method includes changing a state condition of one of the first and second relays while maintaining the state condition of the other of the first and second relays; upon the changing of the state condition, shunting the output of the second relay contacts coupled with the resistive heating element to the switch; and changing the state condition of the other of the first and second relays after completion of debounce for the one of the first and second relays.

DESCRIPTION OF EMBODIMENTS OF THE INVENTION

Figure 1:
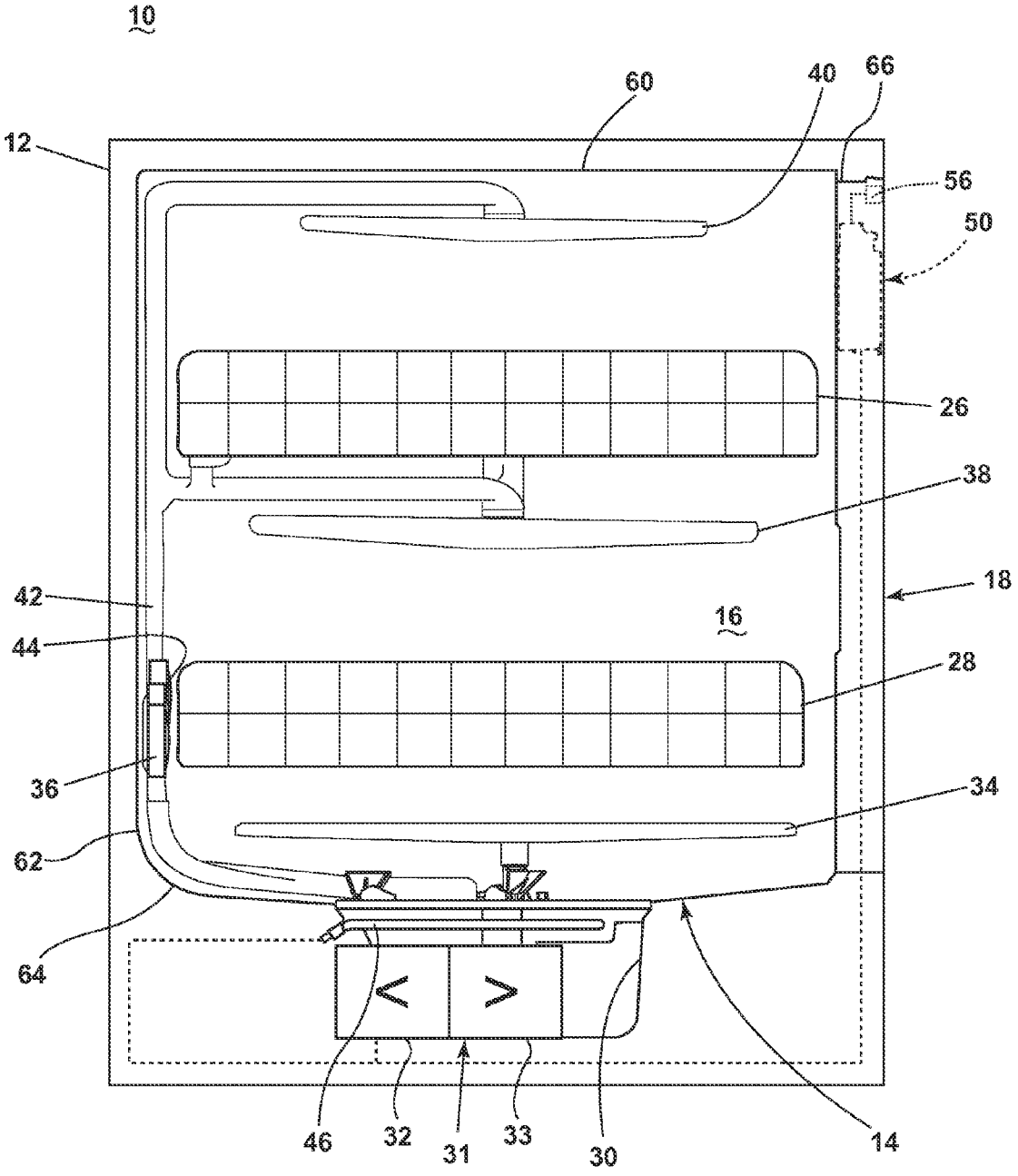
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater such as a resistive heating element 46 may be located within or outside of the sump 30 for heating the coupled liquid contained in the sump 30 or circulated by the pump 33.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
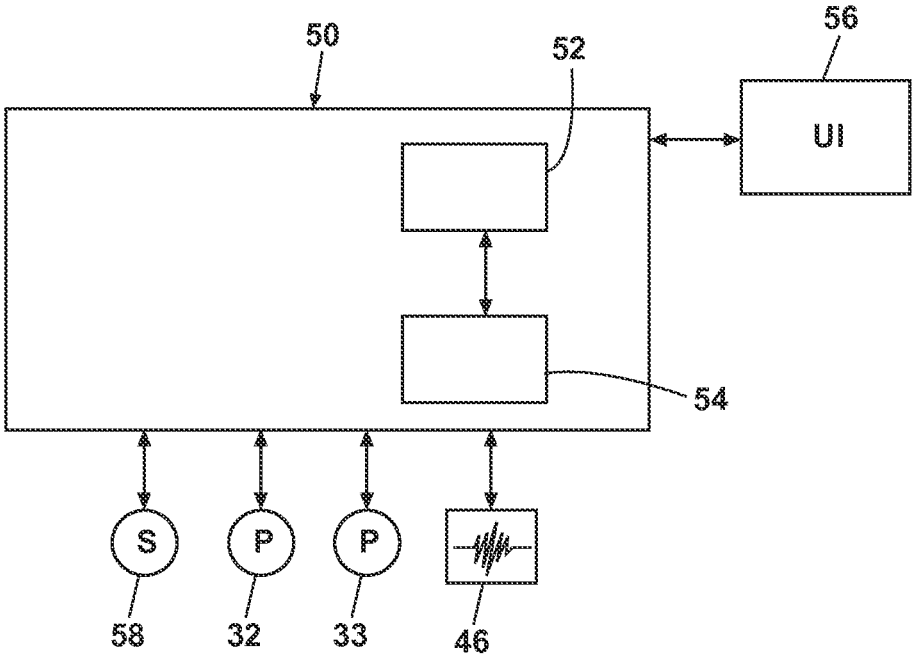
FIG. 2 is a schematic view of a controller of the dishwasher of FIG. 1.

As illustrated schematically in FIG. 2, the controller 50 may be coupled with the heating element 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 3:
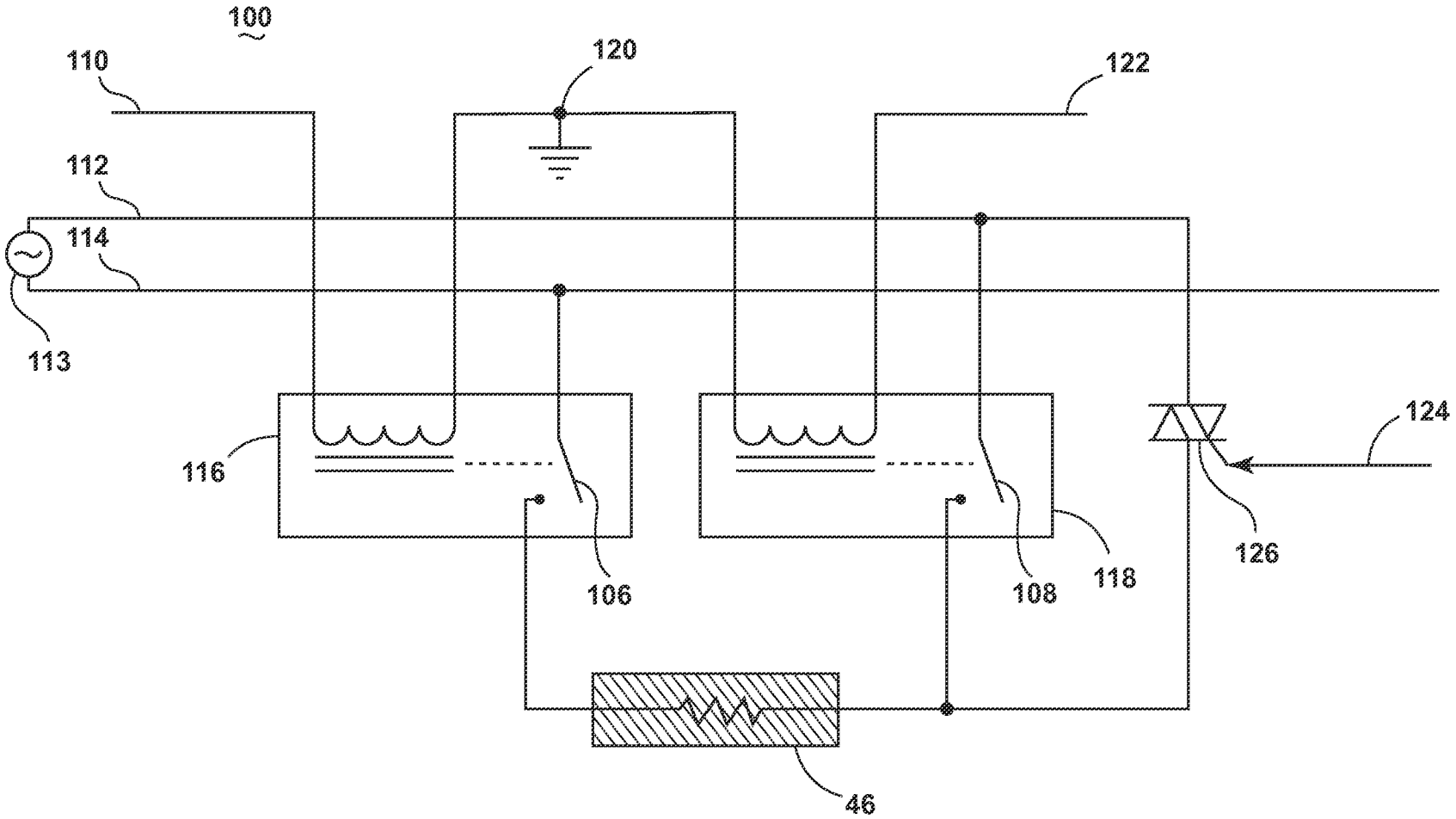
FIG. 3 is a schematic view of an electric heater for the dishwasher of FIG. 1 for operating a resistive heating element according to a second embodiment of the invention.

FIG. 3 illustrates an example of an electric heating system 100, which may have the resistive heating element 46 that is selectively coupled to multiple leads 112, 114 of a power supply 113 by electromechanical relays 116, 118 and a switch 126.

The power supply 113 is a source of electric power for the electric heating element 46 with multiple couplings 112,114. One example of a possible power supply 113 is one that provides a single-phase alternating-current (AC) electric power. The single-phase AC power may have a live wire 114 and a neutral wire 112. A typical voltage differential between a live wire 114 and a neutral wire is 265 V AC RMS at 50 or 60 Hz supply lines.

The electric heating system 100, as illustrated in FIG. 3, has a resistive heating element 46. The resistive heating element 46 provides the thermal output for the electric heating system 100 by the process of Joule heating; that is, the conversion of electricity into heat when current is opposed by the electrical resistance of a conductor. Preferably, the resistive heating element 46 is a thick-film heating element. However, the resistive heating element 46 may be any suitable type of resistive heating element such as resistance wires made of Kanthal, Nichrome or Cupronickel, screen-printed metal ceramic tracks, or positive thermal coefficient ceramic heating elements.

The electromechanical relays 116, 118 selectively couple the power supply 113 to an electrical load. In the implementation of FIG. 3, a first electromechanical relay 116 selectively couples one side of the resistive heating element 46 to the live wire 114. A second electromechanical relay 118 selectively couples the other side of the resistive heating element 46 to the neutral wire 112. As illustrated, the electromechanical relays 116, 118 are electromagnetic switches that use an electromagnet to mechanically operate a switching mechanism.

As illustrated in FIG. 3, the live wire 114 is directly connected to the first electromechanical relay 116 that is configured to toggle between an opened and closed position by coupling or decoupling a pair of contacts 106 internal to the first electromechanical relay 116. When switched to a closed position, the first electromechanical relay 116 is switched to directly couple the live wire 114 to a first side of the resistive heating element 46. When switched to the opened position, the first electromechanical relay 116 is switched to decouple the live wire 114 and one side of the resistive heating element 46.

The neutral wire 112 is directly connected to the second electromechanical relay 118 that is configured to toggle between an opened and closed position by coupling or decoupling a pair of contacts 108 internal to the second electromechanical relay 118. When switched to a closed position, the second electromechanical relay 118 is switched to directly couple the neutral wire 112 to a second side of the resistive heating element 46. When switched to the opened position, the second electromechanical relay 118 is switched to decouple the neutral wire 112 and the second side of the resistive heating element 46.

The neutral wire 112 is also connected to a switch 126 that is connected in parallel to the second pair of contacts 108 of the second electromechanical relay 118. The switch 126 may provide a second coupling between the neutral wire 112 and the second side of the resistive heating element 46. As illustrated, the switch 126 is a bidirectional thyristor where the neutral wire 112 is coupled to a first terminal and the second side of the resistive heating element 46 is connected to a second terminal. However, the switch 126 may be any suitable solid state switching element such as a triode AC switch, a gate turn-off thyristor, an insulated-gate bipolar transistor, a metal oxide semiconductor field-effect transistor and a silicon controlled rectifier.

The controller 50, as shown in FIG. 2, may select the position or state of the switching elements such as the first electromechanical relay 116, the second electromechanical relay 118 and the switch 126 to control the energization or de-energization of the resistive heating element 46. The controller 50 is coupled to the first electromechanical relay 116 by a first communication line 110. The controller 50 is coupled to the second electromechanical relay 118 by a second communication line 122. As illustrated in FIG. 3, both communication lines 110, 122 are coupled to ground 120. The controller 50 is coupled to the switch 126, shown in FIG. 3 as the gate of the bidirectional thyristor, by a third communication line 124. The communication lines 110, 122 and 124 may be implemented as individually wired connections between the controller and each switching device. Alternatively, the communications lines may be elements of a single communications bus or may represent a wireless communications protocol.

Figure 4:
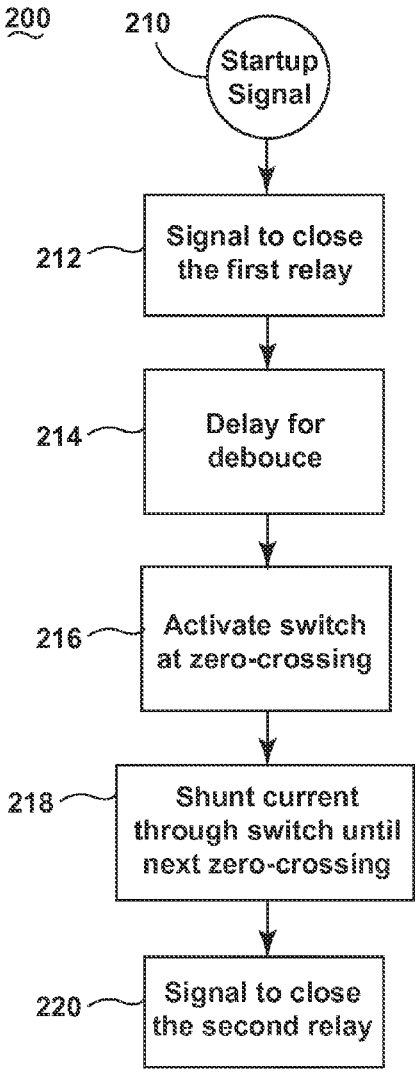
FIG. 4 is a flow chart showing a method of energizing the resistive heating element of the dishwasher of FIG. 1 according to a third embodiment of the invention.

Referring now to FIG. 4, a method of energizing 200 the heating element 46 of the dishwasher 10 begins with a startup signal 210 from the controller 50. Via the first communication line 110, the controller 50, at 212, signals the first electromechanical relay 116 to close while the second electromechanical relay 118 is open. At 214, a delay is observed to allow for the completion of the debounce of the first pair of contacts 106. The delay may be induced by one of many conventional methods known in electronic design including, but not limited to, the integration of a timer circuit, a time-delay relay or a time-delayed signal programmed into the controller 50.

Because they are typically comprised of springy metals that are forcibly coupled or decoupled, contacts in electromechanical relays often make and break contact several times when the electromechanical relay is opened or closed in a process called contact bounce or chatter. Debounce is the cessation of contact bounce. The delay for the debounce is preferably 25 ms, but a suitable range may be 5 to 75 ms depending upon the specific physical characteristics of the contacts implemented in the first electromechanical relay 116 and the electrical characteristics of the power supply 113.

Then, the controller 50, at 216, signals the switch 126 via communication line 124 to activate at the next zero-crossing of the voltage waveform delivered by the AC power supply 113 through the live wire 114. For an AC power supply 113 operating at 60 Hz, the next zero-crossing will occur within 8.3 ms. The switch 126 then couples the live wire 114 to the resistive heating element 46; shunting the output of current through the live wire 114 to the neutral wire 112 by way of the resistive heating element 46. At 218, the shunting of the output current through the switch 126 continues until the next zero-crossing of the voltage waveform is delivered by the AC power supply 113 through the live wire 114. Again, at 60 Hz, the zero-crossing will occur within 8.3 ms. At that zero-crossing, at 220, the second electromechanical relay 118 is closed and the current is directed from the live wire 114 through the first electromechanical relay 116 to the resistive heating element 46 and through the second electromechanical relay 118 to the neutral wire 112.

Figure 5:
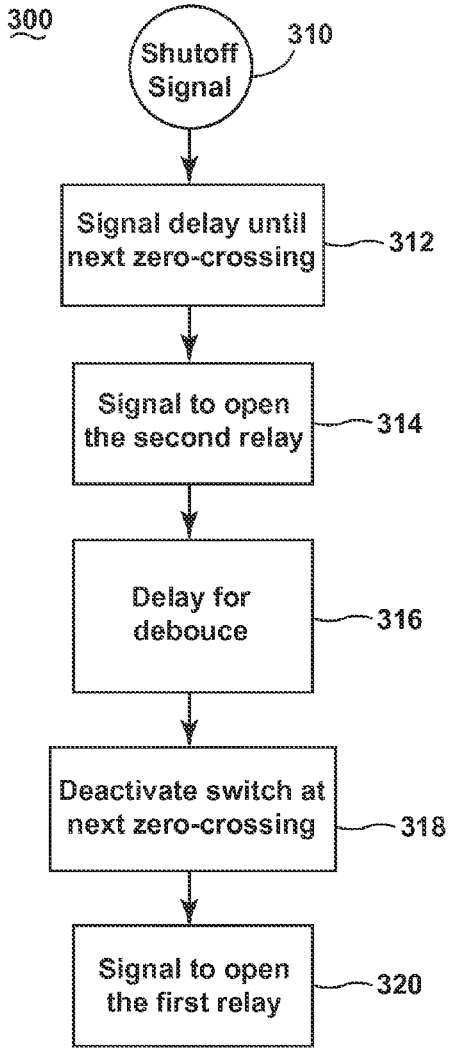
FIG. 5 is a flow chart showing a method of de-energizing the resistive heating element of the dishwasher of FIG. 1 according to a fourth embodiment of the invention.

Referring now to FIG. 5, a method of de-energizing 300 the heating element 46 of the dishwasher 10 begins with a shutoff signal 310 from the controller 50. Initially, the controller 50, at 312 initiates a delay until the next zero-crossing of the voltage waveform is delivered by the AC power supply 113, and then signals the second electromechanical relay 118 via communication line 122 to open, preferably within 8.3 ms, at 314. At 316, a delay is observed to allow for the completion of the debounce of the second pair of contacts 108. The delay for the debounce when de-energizing the heating element 46 is preferably 50 ms, but a suitable range may be from 5 to 75 ms depending upon the specific characteristics of the contacts implemented in the second electromechanical relay 118. The switch 126 may remain activated during the debounce of the second pair of contacts 108 to shunt current away from the second electromechanical relay 118. Then, the controller 50, at 318, signals the switch 126 via communication line 124 to deactivate at the next zero-crossing of the voltage waveform delivered by the AC power supply 113, effectively decoupling the resistive heating element 46 from the neutral wire 112. Finally, via the first communication line 110, the controller 50, at 320, signals the first electromechanical relay 116 to open to completely decouple the resistive heating element 46 from the AC power supply 113 and de-energizing the heater.

Depending upon the specific implementation, the controller 50 may signal a delay until some integer number of zero-crossings has occurred. While a first zero-crossing is expected within 8.3 ms for an AC power supply 113 operating at 60 Hz, an example implementation may require that the switch 126 be activated only on the positive or negative crossing of the voltage waveform. In this case, the delay until the next zero-crossing would be expected within 16.7 ms for an AC power supply 113 operating at 60 Hz. The examples presented should not be considered limiting, as AC power supplies may be used that operate at one of a plurality of frequencies. Additionally, characteristics of the specific switches used must be taken into consideration.

To control the level of thermal output, the electric heating system 100 will selectively energize and de-energize the resistive heating element 46. In this manner, the level of thermal output may be described by the duty cycle of the resistive heating element 46. One result of effecting different levels of thermal output of the resistive heating element 46 is to repeatedly open and close the electromechanical relays 116, 118. Because thick-film heaters may generate a large thermal output very quickly relative to conventional resistive heating elements, the electromechanical relays may need to open and close frequently during a dishwashing cycle of operation. Hard-water calcification, also known as scaling, that is common in water-heating appliances such as dishwashers exacerbates the problem. Hard-water scale buildup acts as a thermal barrier between the heater surface and the water, degrading the heat transfer rate. Consequently, thick-film heaters must engage in fast power cycling to maintain water temperature and not exceed heater surface temperature safety requirements.

The lifetime of the heater in a dishwasher with a thick-film heating element may be compromised by the excessive opening and closing of the electromechanical relay devices. One limiting factor is based upon the mechanical action of opening and shutting the pair of contacts. Over their mechanical lifetime, the contacts may wear out, effectively limiting the number of times the electromechanical relay may open and shut. Another potential problem is caused when current is applied to the contacts during contact bounce. When the power being switched is sufficiently large, the current across the gap between the pair of contacts may ionize the intervening medium and form an electric arc, which may result in the degradation of the pair of contacts and the generation of significant electromagnetic interference. Over their electrical lifetime, a pair of electromechanical relay contacts may fail when the contacts stick or weld, or when critical contact material is lost from either contact to prevent the closing of the electromechanical relay.

Over the lifetime of a dishwasher with a thick-film heater, failure of electromechanical relay contacts may cause a premature failure of the electric heater. One of the technical benefits of the present invention is to improve the electrical lifetime of the electromechanical relay contacts. By shunting current through a solid state switch such as a bidirectional thyristor until the completion of the contact debounce as outlined above, the arcing phenomenon across the contacts may be mitigated or eliminated. This may improve the electrical lifetime of the electromechanical relay contacts to be commensurate with that of the mechanical lifetime.

An additional benefit is an increased resolution in attainable thermal output. By prolonging the electrical lifetime of the electromechanical relay contacts as outlined above, the heater may be selectively cycled to control the average power to range from the upper range of the heater, preferably 2 kW for the thick-film heating element down to a few watts.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating an electric heater comprising a thick-film heater selectively coupled to a live wire of a single-phase AC power supply by a first pair of contacts of a first relay having opened and closed state conditions and selectively coupled to the neutral wire of the single-phase AC power supply by a second pair of contacts of a second relay having opened and closed state conditions and a switch coupled in parallel to the second pair of contacts, the method comprising:

changing a state condition of one of the first and second relays while maintaining the state condition of the other of the first and second relays;

upon the changing of the state condition, shunting the output of the thick-film heater to the switch; and changing the state condition of the other of the first and second relays after completion of debounce for the one of the first and second relays.

2. The method of claim 1 wherein the step changing a state condition of one of the first and second relays while maintaining the state condition of the other of the first and second relays is preceded by a step of delaying a predetermined time.

3. The method of claim 1 wherein the thick-film heater is in a household appliance.

4. The method of claim 3 wherein the household appliance is a dishwasher.

5. The method of claim 1 wherein the completion of debounce for the one of the first and second relays is greater than 25 ms.

6. The method of claim 1 wherein the changing the state condition of both the first and second relays supplies power to the thick-film heater.

7. The method of claim 1 wherein the completion of debounce for the one of the first and second relays is greater than 50 ms.

8. The method of claim 1 wherein the changing the state condition of both the first and second relays removes power to the thick-film heater.

9. The method of claim 2 wherein the predetermined time is the time until the next zero-crossing of the voltage waveform delivered by the AC power supply.

10. The method of claim 2 wherein the predetermined time is at least as great as the time until the next two zero-crossing the voltage waveform delivered by the AC power supply.

11. The method of claim 2 wherein the predetermined time is less than 8.3 ms.

12. The method of claim 2 wherein the predetermined time is less than 16.7 ms.

13. The method of claim 2 wherein the predetermined time is between 0 and 25 ms.

14. The method of claim 1 wherein the shunting the output of the thick-film heater to the switch occurs at a zero-crossing of the voltage waveform delivered by the AC power supply.

15. The method of claim 1 wherein the shunting step is performed by directing the output of the thick-film heater to a solid state switch.

16. The method of claim 15 wherein the solid state switch is one of a bi-directional thyristor, a triode AC switch, a gate turn-off thyristor, an insulated-gate bipolar transistor, a metal oxide semiconductor field-effect transistor and a silicon controlled rectifier.

* * * * *